United States Patent [19]

Stegmeier

[11] 3,974,620

[45] Aug. 17, 1976

[54] METHOD UTILIZING A FORM BOARD FOR SECURING A ROW OF TILES IN ALIGNMENT ALONG AN IRREGULAR FACE OF A SWIMMING POOL BOND BEAM

[76] Inventor: William J. Stegmeier, 1073 Shary Circle, Concord, Calif. 94520

[22] Filed: June 26, 1974

[21] Appl. No.: 483,222

[52] U.S. Cl. ..... 52/747; 52/98; 52/105; 52/390; 249/207

[51] Int. Cl.[2] ..... E04B 1/35; E04G 21/00

[58] Field of Search ..... 249/DIG. .3, 187, 188, 249/189, 207, 61, 52, 155, 219 R, 9, 2; 52/747, 390, 98, 99, 100, 105, 309, 169, 743, 371, 577; 428/43

[56] References Cited

UNITED STATES PATENTS

| | | | |
|---|---|---|---|
| 899,775 | 9/1908 | Whitacre | 52/100 |
| 1,967,444 | 7/1934 | Lowe | 428/43 |
| 2,729,093 | 1/1956 | Ridley | 52/390 |
| 3,159,882 | 12/1964 | Slayter | 52/309 |
| 3,348,801 | 10/1967 | Deason | 249/DIG. 3 |
| 3,526,070 | 9/1970 | Deason | 52/169 |
| 3,547,752 | 12/1970 | Janssen | 161/112 |
| 3,776,501 | 12/1973 | Loftin | 249/2 |
| 3,778,019 | 12/1973 | Stegmeier | 249/DIG. 3 |

*Primary Examiner*—Ernest R. Purser
*Assistant Examiner*—Leslie A. Braun
*Attorney, Agent, or Firm*—C. Michael Zimmerman

[57] ABSTRACT

A method for providing a reference face on the bond beam of a swimming pool during its construction is described. The reference face is then used to secure a tile band around the inner periphery of the pool at the water line. An elongated form board made of expanded plastic foam is positioned against the bond beam at the location at which the reference face is desired, and a line conforming to the contour desired for the reference face is scribed along the board's upper surface. A knife is then used to cut into the form board along the scribed line to define a surface in the form board conforming to the configuration desired for the reference face. The form board has a slit extending along its length from the side face positioned against the bond beam to its interior. When the bond beam is cut from its upper surface to form the desired surface, it is cut to a depth meeting the slit so that a section of the board between the bond beam and the desired surface is removable. The volume from which the form board section has been removed is filled with a cement and, after the cement has set, the form board is removed to expose the desired reference face. The bond beam face is otherwise filled to the reference face as might be required to secure the tile to the same in the desired alignment.

17 Claims, 6 Drawing Figures

FIG. 1
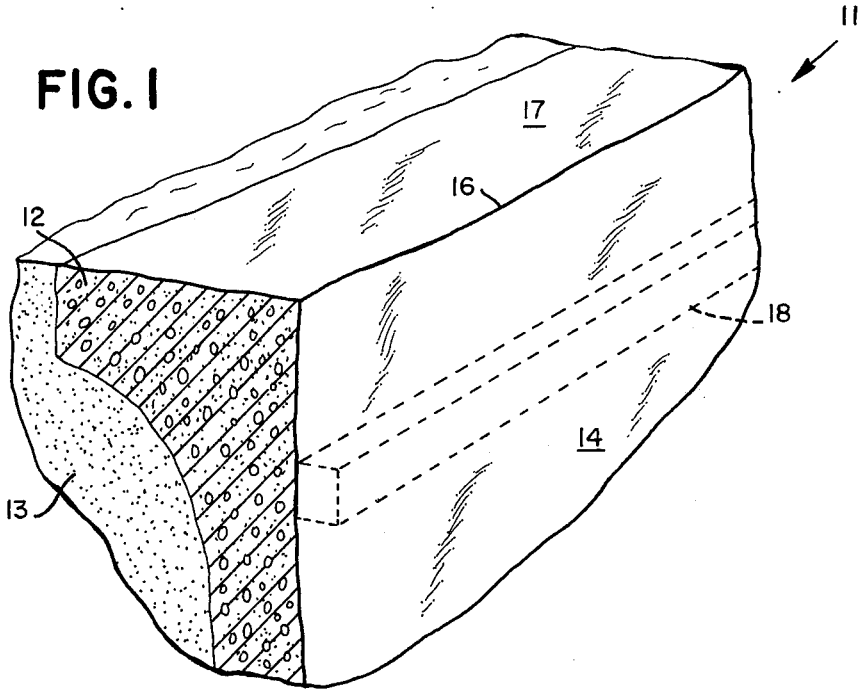
FIG. 2
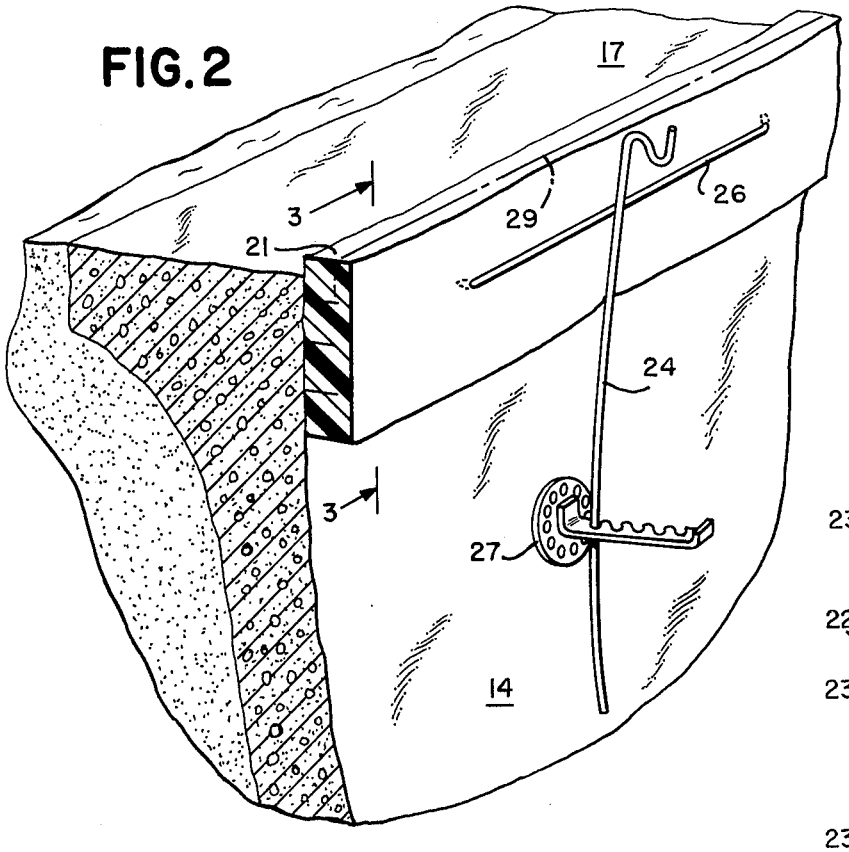
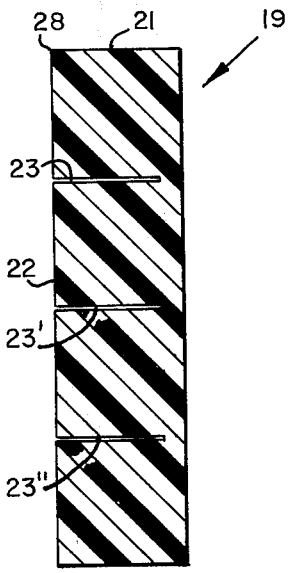
FIG. 3

METHOD UTILIZING A FORM BOARD FOR SECURING A ROW OF TILES IN ALIGNMENT ALONG AN IRREGULAR FACE OF A SWIMMING POOL BOND BEAM

BACKGROUND OF THE INVENTION

This invention relates to the construction of swimming pools and the like and, more particularly, to a method and apparatus for securing a horizontal row of tiles in alignment to a swimming pool wall along the upper edge portion thereof.

Swimming pools designed to be permanently erected typically are formed by excavating a hole in the ground generally following the contours desired for the pool, and then lining the hole with reinforcing steel on top of which a cement mixture is sprayed to form a concrete bottom and concrete side walls. A thickened concrete portion, referred to in the art as a "bond beam," is provided around the pool at the top of the side walls to structurally define the peripheral edge of the pool and tie the pool side walls together. After the concrete forming the pool side walls and bond beam has cured sufficiently, the cavity defining faces of the concrete walls and of the bond beam are covered with a suitable finishing material.

In the past, it was common to finish the interior wall surfaces of a swimming pool with ceramic tile or the like. However because of the present high costs for material and labor associated with laying tile, it is now more common to face most of the interior of the pool with a finishing coat of a fine aggregate concrete. It is generally necessary, though, to provide at least a single horizontal row of tile adjacent the upper edge portion of the pool side walls at the elevation at which the water level is to be maintained in the pool. The reason for such tile band is that body oils collect along the water surface in a swimming pool and tend to adhere to any concrete at the water level with considerable tenacity and stain the same. The hard, substantially impervous finish provided by a bond of glazed ceramic tiles at the water level, though, facilitates removal of such oils and other matter.

The tile laying or setting procedure now universally followed is for a tile setter to locate the highest elevation along the pool wall and then patch or fill the upper edge of the pool wall to bring it to this elevation. An elongated ledge board is then fixed to the face of the pool wall parallel but below the water line desired in the finished pool. A suitable mortar is then prepared, spread along the proposed pool water line above the ledger board, and each block of tile is seated upon the ledger board and pressed into the mortar. Care is taken during the setting of the tile to align adjacent tiles horizontally in a desired orientation relative to one another, i.e., to make a straight or curved row. The surface of the ledger board on which the tile blocks are seated acts to align the tiles vertically with respect to one another. After the mortar has set, the ledger board is stripped from the wall, and the wall surfaces below the tile band are covered with a concrete finishing material as previously stated.

The above procedure is generally satisfactory for solid ceramic tile blocks capable of supporting themselves and, hence, capable of being supported from below by the ledger board. It will be appreciated, however, that ledger board support, per se, is largely ineffective for properly locating tiles which are not self-supporting. In this connection, for aesthetic reasons many customers desire that the tile band be formed by a mosaic of smaller tiles. Such mosaic tile are typically sold with a flexible backing sheet securing a plurality of the same together in a rectangular pattern with uniform spacing between adjacent tiles. The backing sheet is normally in the form of a web which enables the mortar used to secure the same to a pool face to directly contact the individual tiles. Because such a sheet of mosaic tile is not self-supporting, i.e., will not maintain a planar relationship when supported solely along its bottom edge, various auxiliary supporting arrangements have been provided to maintain the tile in a planar relationship so that it can be supported by a ledger board. For example, reference is made to my U.S. Pat. No. 3,850,404 issued Nov. 26, 1975 for TILE-SETTING APPARATUS which describes a rigid backing structure which is utilizable with mosaic tile sheets to provide rigidity thereto for appropriately aligning and securing the same to a pool wall. It is desirable, however, to simplify the securence of tile, particularly mosaic tile sheets, in a properly aligned horizontal row to the face of a pool bond beam, i.e. adjacent the upper edge of the pool side wall.

SUMMARY OF THE INVENTION

The present invention provides a method and apparatus for securing a row of tiles or the like in proper alignment along an irregular face of a bond beam during the construction of a swimming pool which does not rely upon the tile having structural rigidity for such purpose. Basically, the method utilizes a form board to provide both an upper reference line and a reference face on the bond beam which will define the proper vertical and horizontal alignment for the tile without reliance on a ledger board. The invention further includes a form board which is especially adapted for carrying out the method.

The method and apparatus of the invention not only eliminate the necessity of using a ledger board for the tile setting operation, but also provide a much simpler and quicker way of attaining the desired proper alignment and securance of tile to a bond beam face. In its basic aspects, the method includes the steps of providing an elongated form board having a side face meeting another surface to define a straight edge, and positioning the form board with such side face against the bond beam inner face with its straight edge located at, or most desirably above, the highest irregularity along the bond beam edge projecting from the bond beam in a direction parallel to the side face of the face board, i.e., extending upward from the beam edge. The method further includes filling in the irregular edge of the bond beam to the straight edge of the ledger board with a cement to thereby straighten the wall edge. The ledger board is then removed and the straightened bond beam edge is used as a reference line for securing a row of tile to the wall in adjacent vertical alignment. The method of the invention compensates for any concavities or depressions on the generally vertical, inner surface of the bond beam by providing a reference face thereon defining the desired relative orientation of the tile. In this connection, the form board is also most desirably provided with a surface generally parallel to its side face but spaced inwardly of the board therefrom defining a uniform contour following the desired adjacent orientation alignment desired for the tiles. The method of the invention then includes the additional step of filling the volume or, in other words, cavity between the irregular wall face of the bond beam and such surface of the form board with a cement. After the cement has hardened and the ledger board is removed to expose the added cement, an alignment surface having the contour desired for the tiles will be provided. Thereafter, the alignment surface is used as a reference face for securing the row of tiles in the desired adjacent orientation alignment relative to one another.

Most desirably, the surface of the form board which will provide the bond beam reference face is formed in the board after it is positioned against the bond beam by removing a section of the form board between the bond beam and the desired form surface. To this end, after the form board is positioned a line is scribed on its upper surface conforming to the contour desired for the form surface and the board is cut on such line into its interior to define such surface. This formation of the surface after the form board is positioned against the bond beam will assure that any irregularity in the bond beam face which might bend the form board will not likewise distort the form surface. To facilitate such cutting to provide the form surface, the form board itself has at least one slit extending lengthwise thereinto from its side face, and is made of a material which is precisely cuttable. With such a construction, a section of the ledger board can be removed in accordance with the method merely by cutting into the block from its upper surface to the slit in order to define the properly contoured form surface. That is, in order to remove the section, it is only necessary to cut into the block in one direction, i.e., from its upper surface downward to the slit, rather than to also slice the section from the block by making a transverse cut thereinto. Without the preslitting, it would be difficult to provide such a transverse cut without first removing the form board from its position against the wall.

The present invention includes other features and advantages, many of which will be described or will become apparent from the following more detailed description of a preferred embodiment.

BRIEF DESCRIPTION OF THE DRAWINGS

With reference to the accompanying three sheets of drawings:

FIG. 1 is a partial perspective view illustrating the upper portion of a typical structural construction of a swimming pool;

FIG. 2 is a partial perspective view similar to FIG. 1 illustrating a preferred embodiment of a form board of the invention positioned against the upper end portion of the swimming pool wall in accordance with the method;

FIG. 3 is an enlarged, sectional view through the preferred embodiment of a form board, illustrating details of its construction;

DETAILED DESCRIPTION OF THE PREFERRED EMBODIMENTS

Figure 4:
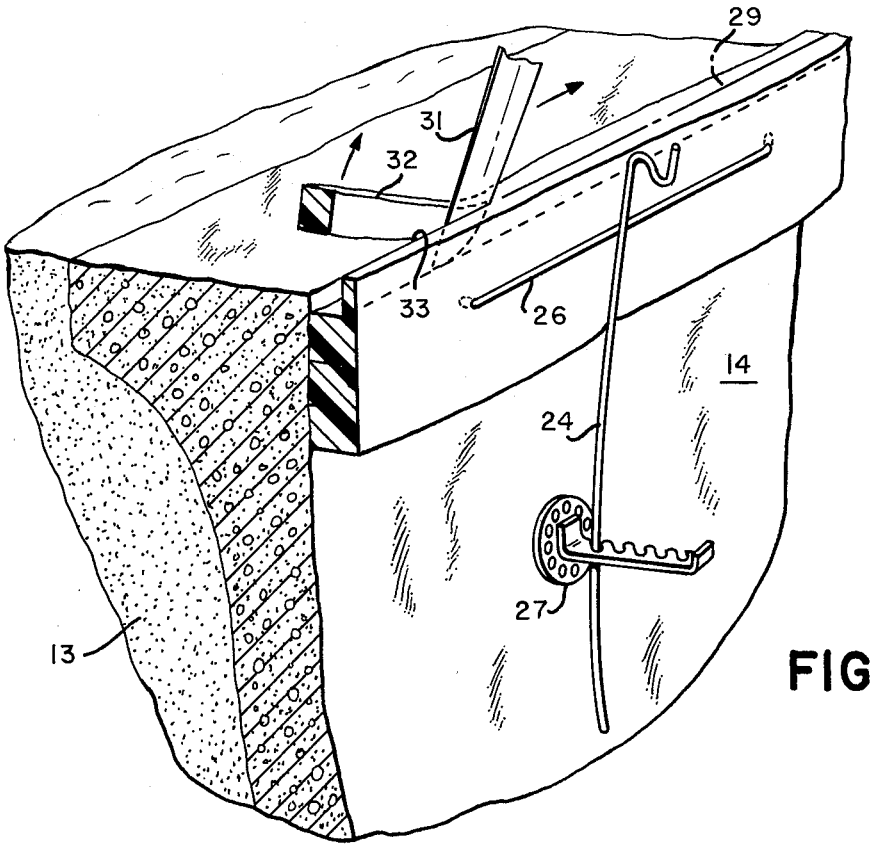
FIGS. 4 and 5 are views similar to FIG. 2 illustrating steps in the method of the invention.

The invention will be described in detail in connection with the application of a tile band to the upper end portion of the vertical wall of a swimming pool. Such a wall is illustrated in FIG. 1 in the stage of construction to which the present invention relates. The wall, which is generally referred to by the reference numeral 11, includes an enlarged upper end portion 12 referred to in the art as a "bond beam". The purpose of the bond beam is to provide structural strength at the upper edge of the pool and tie the side wall of the pool together. Although not shown, it will be appreciated that both the side wall and the bond beam are curved or angled at various locations along its length to thereby define an enclosed cavity for containing water.

A pool wall such as that shown is typically formed by spraying a gunite or other concrete mixture under pressure against a form which, to a great extent, is provided by the earthen mass bordering the cavity within which the pool is to be constructed. The earthen mass is represented at 13. Reinforcing steel or the like may be provided along the walls of the cavity, and the concrete mixture sprayed thereover to provide a reinforced concrete pool structure.

When swimming pool walls are constructed either in this manner or in other manners, the inner face 14 of the wall is typically irregular, i.e., includes depressions and projections at random locations over its full extent. Moreover, the upper edge 16 where the generally vertical wall meets the upper generally horizontal surface 17 of the bond beam includes irregularities in the vertical direction. From the aesthetic standpoint, though, it is important that the finished exposed face of the pool have a uniform contour without depressions and projections. Moreover, it is important that the row or band of ceramic tile provided on the wall at the water level to collect body oils and the like not be wavy or vertically misaligned. It is the usual practice to secure the tiles to the wall face 14, correcting the irregularities in the wall, and then provide a finishing coating over the remainder of the interior of the pool to smooth the exposed surfaces and provide a desired finish thereon. The tiles are often aligned by supporting the same on a ledger board which is temporarily secured to the pool wall in, for example, the position illustrated at 18 in phantom in FIG. 1. That is, the tiles are pressed into mortar or the like applied to the bond beam face above the ledger board, with the ledger board defining the bottom edge line for such tiles. The tiles are aligned horizontally adjacent one another in the mortar by either eye alignment or following a line placed on the upper surface of the ledger board. While other methods have also been used to align the tiles along the pool face, most rely on a ledger board or other support for holding the tiles in place. As mentioned previously, these methods do not readily lend themselves to applying flexible sheets of mosaic tile to the pool face in proper alignment.

The present invention relates to both a method and apparatus which facilitate the securance of flexible sheets of mosaic tile or the like in proper alignment on a pool face, as well as also generally simplify the tile setting procedure. The method and apparatus condition both the wall face 14 and the upper edge 16 so that they themselves define the references necessary to assure proper alignment of the tiles, thereby doing away with the necessity of a temporarily placed ledger board or other tile supporting structure. To this end, the method includes providing a form board which is especially adapted for the construction of a reference face along the pool wall defining the contour desired for the tile. A preferred embodiment of such form board is generally referred to in FIGS. 2 and 3 by the reference numeral 19. As is illustrated therein, the form board is provided as an elongated, e.g., 4–6 feet in length, block of material having a rectangular cross-section. Although the dimensions of the form board are not critical to the invention, it is preferred for reasons which will be discussed hereinafter that the board have a width of at least about two inches, and a breadth (in the vertical direction as viewed in the drawing) of about 8 inches. The form board has an upper surface 21 (hereinafter sometimes referred to as a "leveling" surface) meeting a side face 22 which is generally planar for positioning against the irregular face 14 of the pool. The leveling surface 21 is flat and is orthogonally related to the side face of the block.

As can best be seen from FIG. 3, the form board 19 has 3 slits 23, 23′ and 23″ extending lengthwise thereinto from its side face 22. Each of the slits 23 is straight and extends for the full length of the block. The slits are generally parallel to one another and equally spaced apart along the side face 22. The purpose of the slits 23 will be discussed hereinafter.

The next step in the method of the invention is to position the form board against the irregular face of the pool bond beam along the location at which the row of tiles is to be secured. More particularly, as is shown in FIG. 2, the form board is positioned against the bond beam face with its upper surface 21 located above any irregularity in the bond beam edge 16, i.e., above any irregularity in such edge which projects parallel to the side face of the form board. Preferably, the surface 21 is positioned at least one-half inch above the highest projection to assure that the full upper surface of the bond beam can be covered with a cement as will be described. As is shown, the form board is positioned along the bond beam with the side face 22 thereof against the bond beam wall face.

Although various means can be used to maintain the form board 19 in position against the bond beam face, the spring holder and fulcrum arrangement disclosed and claimed in U.S. Pat. No. 3,904,717 issued Sept. 9, 1975 for APPARATUS FOR AND METHOD OF EQUIPPING SWIMMING POOLS AND THE LIKE WITH A TILE BAND AND CANTILEVER DECK, the disclosure of which is hereby incorporated by reference, is especially useful for this purpose. Thus, a spring rod holder 24 having a crossbar 26 in engagement with the form board is maintained resiliently loaded against the board by a fulcrum component 27 in accordance with the teachings of my copending patent application. Although only one spring bar holder and fulcrum component combination is illustrated, it will be appreciated that a plurality of the same are provided around the wall of the pool to maintain a plurality of lengthwise adjacent form boards in position against the bond beam for the full periphery of the pool wall.

The form board 19 is most desirably flexible lengthwise so that it can be bent to follow the curved contours of a free form pool. Such flexibility also enables the board to bend along its length to follow the contours of most gross irregularities in the portion of the wall face against which it is positioned. Thus, the form board when resiliently urged against the wall face by the spring holder-fulcrum combinations will take on a somewhat wavy appearance as can be seen in FIG. 2. It will be appreciated, however, that insofar as abrupt irregularities in the wall having minimum transverse dimensional extents are concerned, the form board will bridge the same, rather than follow their contour. Thus, the form board should not be completely limp, but rather only sufficient flexibility to follow the contours of those irregularities in the wall face which have a significant extent along the form board wall face. In this connection, a suitable material for the form board, not only to provide the desired flexibility but also to satisfy the other previously and hereinafter mentioned criteria is an expanded, rigid foam plastic, such as expanded polystyrene.

In those instances in which it is only necessary to straighten vertical irregularities in the edge 16 of the form board because the only concern is for the proper vertical alignment of adjacent tiles, the form board is utilizable to provide filling along the upper surface of the bond beam to the straight edge 28 formed by the form board where the upper leveling surface 21 and side face surface 22 meet. Most often, however, it is necessary that the face 14 of the bond beam pool, as well as the edge 16, be conditioned to provide horizontal alignment of adjacent tiles in a tile bond. The method of the invention therefore preferably includes additional steps providing such a conditioning. More particularly, the form board 19 is provided with a surface which is positioned inwardly of the side face 22 but generally parallel thereto, having a contour or configuration defining the orientation alignment desired for horizontally adjacent tiles in the finished tile band. This is most simply accomplished by removing a section of the form board between the bond beam face and a surface providing the desired configuration. Because the form board is somewhat flexible and will generally conform to depressions and projections along the bond beam face, the surface is preferably provided on the form board after the form board is positioned against the bond beam face. This is easily accomplished after the form board is positioned by first scribing a line on the upper leveling surface 21 of the form board following the desired contour, and thereafter cutting the form board material along such line.

FIG. 2 illustrates a line 29 representing a desired contour applied to the leveling surface 21. There are various ways in which such a line can be provided. For example, in the exemplary arrangement illustrated in which a straight line is shown representing a desired planar relationship of adjacent tiles, the line can be provided as a chalk line. That is, a string covered with chalk or other marking substance can be stretched between two points known to be on the desired plane and then struck or plucked so that it will transfer the chalk to the surface 21. If the line is to be curved, any edge providing the desired curve can be used to scribe a line on the surface conforming thereto. In this connection, it is usual in free form pools in which uniform curves are provided to utilize a flexible plastic pipe bent to the desired curvature to provide a scribing edge.

After the line 29 is scribed on the surface, the board is cut along such line to define the surface conforming to the desired horizontal alignment of the tiles. That is, as is illustrated in FIG. 4, a knife 31 or the like is manipulated along the scribed line 29, generally parallel to the side face 22 of the form board down to the slit 23. As is illustrated, a section 32 of the form board is thus separated from the remainder of such form board. It will, therefore, be seen that one purpose of the slits 23 is to enable such a section to be removed after the form board is in position merely with a single cut extending transverse thereto.

Most desirably, the form board is cut to a depth which extends below the irregular edge of the bond beam as is illustrated. The result is that the upper edge portion of the bond beam face is exposed, and thereby defines at least a portion of one side of the volume or cavity which is later filled with a cement as will be described to provide the desired alignment surface for the tiles. In this connection, depending upon the depth of the irregularities along the upper surface of the bond beam, it may be necessary to cut into the material beyond the first slit 23 to the slit 23', for example, in order to assure that the upper edge portion of the bond beam face is exposed along its full length.

It will be recognized that because the leveling surface 21 is flat, the form board edge 33 formed by the removal of the section 32 will be straight just as is the edge of the form board 28. That is, because the leveling surface has a contour (in this case flat) which is the same across the width of the form board block, the edge 33 will retain the same elevation as the edge 28 along its full length, irrespective of the location along the width of the surface 21 at which the cut is made to remove the section 32.

Figure 5:
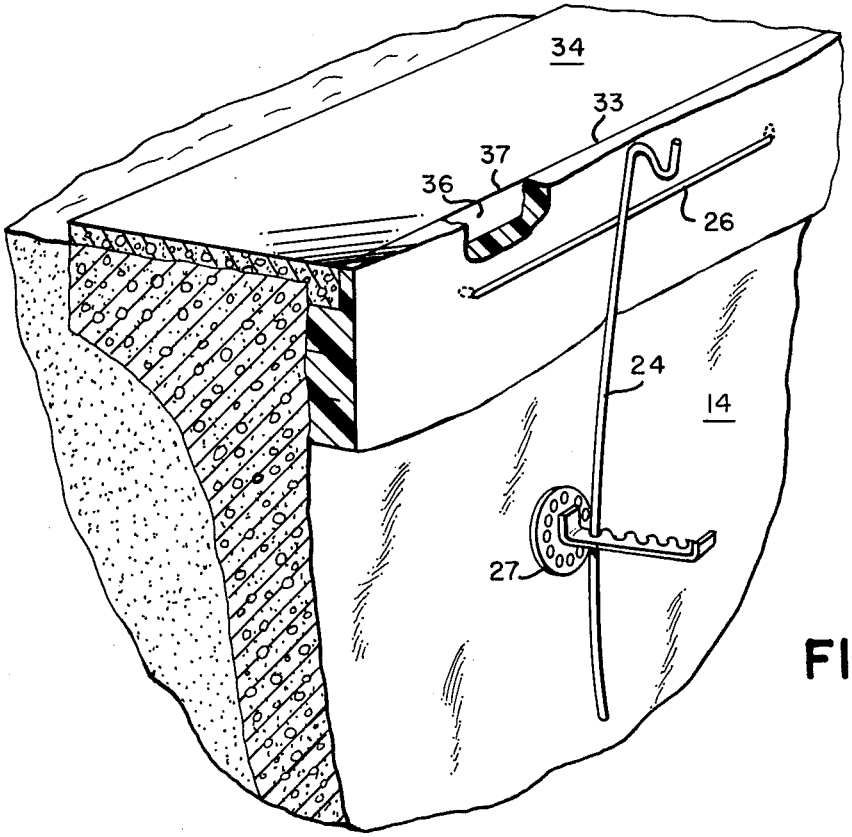

After removal of the section 32 for the full length of the bond beam, both the desired straight reference line to supplant the edge 16 of the bond beam and the horizontal tile alignment surface along the bond beam face 14 can be provided, merely by filling the cavity between the irregular wall face 14 and the cut surface of the form board with a cement at the same time cement is provided on the upper surface of the bond beam to bring the same up to the straight edge provided by the line 33. FIG. 5 illustrates the bond beam with a cement layer 34 so applied thereto. As is illustrated where the form board is shown broken away, the cement fill, after setting, will provide an alignment surface 36 which conforms to the cut surface in the form board and, hence, to the desired alignment for the tiles. Moreover, a straightened edge 37 conforming to the straight edge 33 is provided as a reference line to enable vertical alignment of adjacent tiles.

Figure 6:
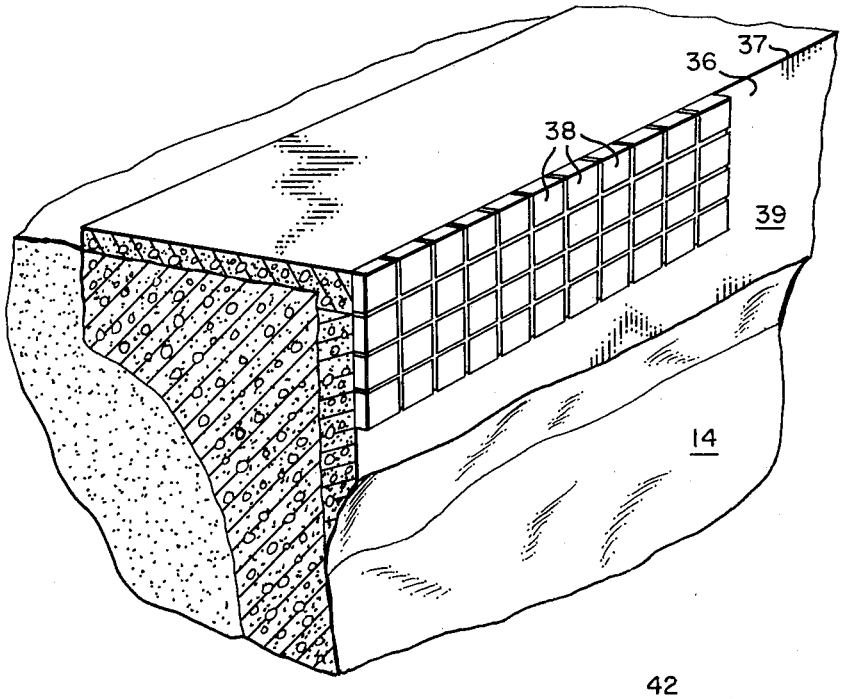
FIG. 6 is another partial perspective view of a swimming pool wall illustrating the securance of mosaic tile thereto in accordance with the method of the invention.

FIG. 6 illustrates the use of the alignment or reference face 36 and the reference line 37 to secure a row of mosaic tile 38 to the bond beam face in an alignment determined by the reference line and face. More particularly, after the cement providing the reference line and face is set, the form board is removed from its position against the bond beam face. In this connection, the reference face 36 typically does not itself have the depth required in a vertical direction to provide a sufficient surface area for securance of the full sheets of tile thereto. Thus the method of the invention further includes the step of applying a cement to the bond beam face to fill the same out to the alignment surface. Such a cement layer, indicated in FIG. 6 by the reference numeral 39, can be applied, for example, with a trowel using the reference face 36 as a guide to assure that the same has the required alignment. The mosaic tile, typically provided as mentioned previously in flexible, rectangular sheets having a plurality of tiles is then secured to the built-out face. The reference line 37 is used to provide vertical alignment of adjacent tile sheets and the horizontal alignment of such sheets is automatically provided by the reference face 36 and fill 39. Thus, a row of the flexible sheets or, in other words, a row of tiles can thus be applied in the desired alignment without the use of a supporting ledger board or the like as in the past.

Figure 8:
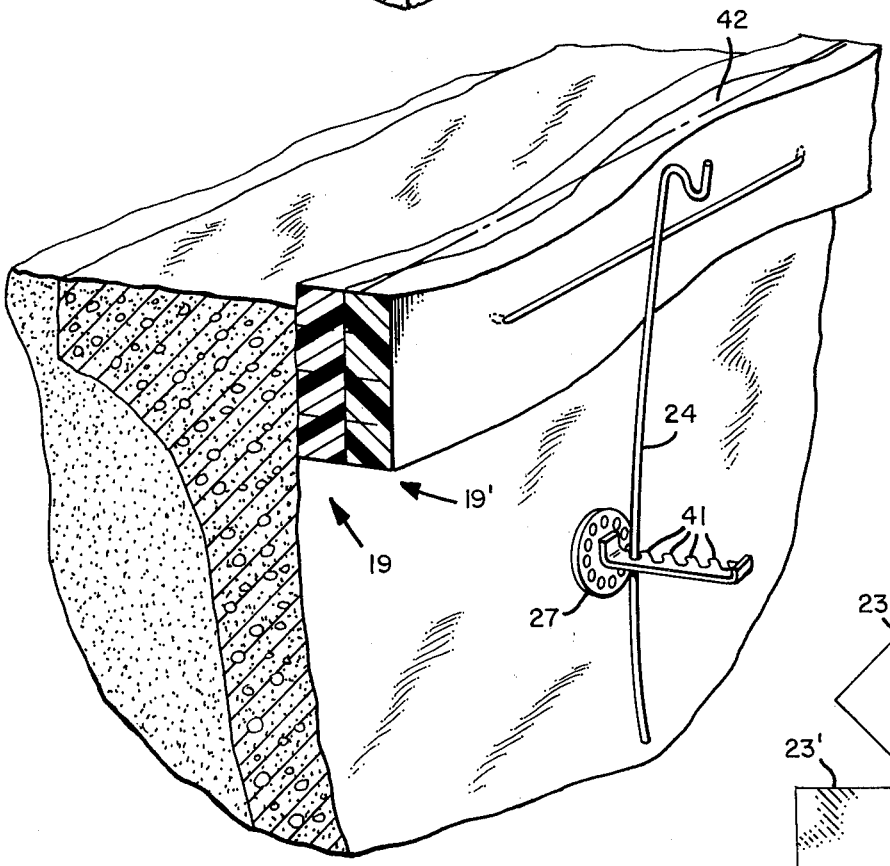
FIG. 8 is a partial perspective view illustrating the manner in which a pair of form boards of the invention are usable in accordance with the invention when the irregular depressions or projections on the pool wall face are of a depth greater than the width of a single form board.

It is preferred that the form board block have a width greater than the greatest dimensional difference between depressions and projections on most irregular wall faces with which the form board is apt to be used. The two inch width previously mentioned is sufficiently great for most swimming pool constructions. However, in those instances in which a greater dimensional difference between depressions and projections are encountered, the invention readily lends itself to accommodating such a difference. More particularly, with reference to FIG. 8, it will be seen that a pair of form boards 19 and 19' can be used together to double the width available. The spring holder-fulcrum combination 24, 27 will accommodate the double width simply by varying, if required, the particular notch 41 in the fulcrum component that is engaged by the spring holder 24.

A scribed line 42 is shown on the combined leveling surface provided by the two form boards 19 and 19'. As illustrated, such scribed line extends from the leveling surface of one of the form boards over into the other. It will be recognized that upon a knife being used to cut into the form boards to remove a section, the section so removed will actually be a portion of both boards. In this connection, the slits 23 extend sufficiently through the width of each of the blocks to enable the section to be manually broken apart at the locations at which the section to be removed might still be secured to the remainder of the block.

Figure 7:
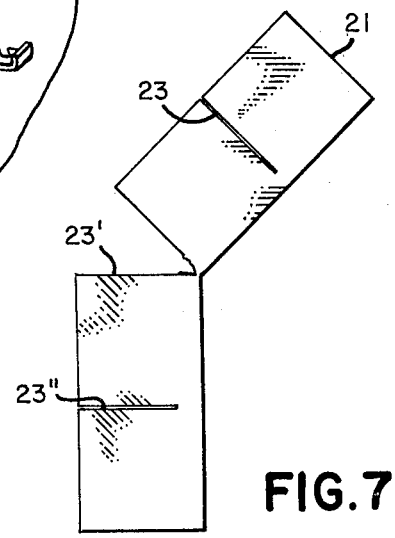
FIG. 7 is an enlarged, sectional view of the form board of the invention illustrating it being separated into two components.

Provision of the slits 23 through the width of the block for a distance sufficient to enable the block to be manually broken apart has another major advantage. That is, it is not unusual for the vertical depth of irregularities along the edge 16 of the bond beam upper surface to be no greater than the distance between the upper leveling surface of the form board and the first slit 23 therein. In such a situation, the portion of the form board provided lower than the slit 23' is of no use. As shown in FIG. 7, though, the form board can be easily broken along the slit 23' to provide, in effect, two form boards from the one. That is, the lower half of the form board is also useable to provide a desired alignment surface in accordance with the invention, merely by using the surface 23' as a leveling surface. The potential use of the surfaces provided by the slits 23 for leveling surfaces is another reason why the slits 23' are straight, i.e., provide flat cut surfaces.

Although the invention has been described in connection with preferred embodiments thereof, it will be appreciated by those skilled in the art that various changes and modifications can be made. In this connection, wherever in the specification or the claims the term "cement" is used, this term is meant to include mortar or so-called "mud" and other materials which can be applied to the bond beam and yet will set or otherwise take on a self-supporting surface configuration. Also, more significant changes and modifications to the embodiments described can be made without departing from the spirit of the invention. It is, therefore, intended that the coverage afforded applicant be limited only by the claims and their equivalent language.

I claim:

1. A method of securing a row of tiles or the like to an irregular face of a bond beam during the construction of a swimming pool or the like comprising:

a. providing an elongated form board of a cuttable material having a side face and an upper leveling surface meeting said side face, and having a slit extending lengthwise thereinto from said side face at a location spaced from said leveling surface;

b. positioning said form board with said side face against said irregular face of said bond beam along the location at which said row of tiles is to be secured;

c. providing a surface of said form board defining the alignment desired for said tiles which is generally parallel to said side face and spaced inwardly from said bond beam to provide a cavity along said location at which said row of tiles is to be secured, by removing a section of said form board between said side face and said surface after said form board is positioned with said side face against said irregular face of said bond beam through the steps of:

1. scribing a line on said leveling surface conforming to said contour defining a desired adjacent orientation of alignment for said tiles; and 2. cutting said material along said scribed line generally parallel to said side face between said leveling surface and said slit to form said surface having said contour;

d. filling the cavity between said irregular bond beam face and said surface of said form board providing said alignment desired for said tiles with a cement;

e. allowing said cement within said cavity to set to a self-supporting configuration at said surface of said form board to thereby form an alignment surface for said tile conforming to said form board surface;

f. removing said form board from its position against said bond beam face; and g. thereafter using said alignment surface as a reference face for securing a row of tiles to said bond beam in the desired adjacent alignment desired in the finished swimming pool.

2. The method of claim 1 wherein said step of using said alignment surface as a reference face for securing a row of tiles to said bond beam face includes the further steps after said form board is removed from its position of:

a. applying a cement to said bond beam face to fill the same out to said alignment surface at the location at which a row of tiles is to be secured thereto; and b. applying a row of tiles to said built-out bond beam face.

3. The method of claim 1 wherein said form board has the flexibility along its length necessary for it to be bent to generally follow the contours of irregularities in the portion of said wall face against which it is positioned, and has a width greater than the greatest dimensional difference between depressions and projections on said irregular face along the location at which said row of tiles is to be placed; and wherein said step of positioning said form board with said side face thereof against said irregular face of said bond beam includes the step of forcing said form board against said bond beam face in general conformance with said depressions and projections.

4. The method of claim 1 wherein said leveling surface of said form board meets said surface of said board providing said desired tile alignment in a line defining a straight edge, and wherein said row of tiles is to be secured along said irregular face of said bond beam adjacent an irregular edge thereof where said beam face meets the upper surface of said bond beam; and wherein said form board is positioned adjacent said irregular edge with said straight edge of said board located beyond any irregularity in said bond beam which projects parallel to said side face of said form board; and including the further step of filling in said irregular edge of said bond beam to said form board straight edge with a cement to straighten said concrete wall edge.

5. The method of claim 4 wherein said step of using said alignment surface as a reference face for securing a row of tiles to said bond beams includes the further steps after said form board is removed from its position of:

a. applying cement to said bond beam face to fill the same out to said alignment surface at the location at which a row of tiles is to be secured thereto; and b. applying a row of tiles to said built-out bond beam face.

6. A method of securing a row of tiles or the like during the construction of a swimming pool or the like to an irregular face of a bond beam adjacent an irregular edge thereof where said face meets the upper surface of said bond beam comprising:

a. providing an elongated form board having a side face meeting a leveling surface;

b. positioning said form board with said side face against said irregular face of said bond beam adjacent said irregular edge and along the location at which said row of tiles is to be secured;

c. providing said form board with a surface inwardly and generally parallel to said side face having a contour defining an adjacent orientation alignment desired for said tiles in the finished swimming pool so that said leveling surface of said form board meets said surface providing said desired alignment in a line defining a straight edge, by removing a section of said form board between said side face and said surface after said form board is positioned with said side face against said irregular face of said bond beam, said form board being positioned adjacent said irregular edge with said straight edge of said board located beyond any irregularity in said bond beam which projects parallel to said side face of said form board;

d. filling the cavity between said irregular bond beam face and said surface of said form board providing said alignment desired for said tiles with a cement;

e. filling in said irregular edge of said bond beam to said form board straight edge with a cement to straighten said concrete wall edge;

f. allowing said cement within said cavity to set to a self-supporting configuration at said surface of said form board to thereby form an alignment surface for said tiles conforming to said form board surface;

g. removing said form board from its position against said bond beam face; and h. thereafter using said alignment surface as a reference face for securing a row of tiles to said bond beam in the desired adjacent orientation alignment desired in the finished swimming pool.

7. The method of claim 6 wherein said step of removing a section of said form board includes removing a section of said form board having a depth extending below said irregular edge of said bond beam whereby said irregular bond beam face defines the side of said volume which is filled to provide said alignment surface of said tiles.

8. The method of claim 6 wherein the elongated form board provided is of a material which is cuttable, includes an upper leveling surface meeting said side face, and has a slit extending lengthwise thereinto from said side face at a location spaced from said leveling surface; and said step of removing a section of said form board between said side face thereof and a surface thereof generally parallel to said side face includes the steps of:

a. scribing a line on said leveling surface conforming to said contour defining a desired adjacent orientation of alignment for said tiles; and b. cutting said material along said scribed line generally parallel to said side face between said leveling surface and said slit to form said surface having said contour.

9. The method of claim 8 wherein said leveling surface is flat to provide a straight line straight edge irrespective of the location across said leveling surface at which said material is cut to form said alignment surface.

10. A method of securing a row of tile or the like in alignment along an irregular face of a concrete or the like wall comprising:

a. providing an elongated form board having a side face;

b. positioning said form board with said side face against said irregular face of said wall along the location at which said row of tile is to be secured;

c. providing said form board with a surface inwardly and generally parallel to said side face having a contour defining an adjacent orientation alignment desired for said tiles, by removing a section of said form board between said side face and said surface after said form board is positioned with said side face against said irregular wall face along the location at which said row of tiles is to be secured;

d. filling the volume between said irregular wall face and said surface of said form board providing said alignment desired for said tiles with cement to define an alignment surface for said tiles;

e. removing said form board from its position adjacent said irregular face of said wall; and f. thereafter using said alignment surface as a reference face for securing a row of tiles to said wall face in a desired adjacent orientation alignment.

11. The method of claim 10 wherein said step of using said alignment surface as a reference face for securing a row of tiles to said wall face includes the further steps after said form board is removed from its position of:

a. applying a cement to said wall face to fill the same out to said alignment surface at the location at which a row of tiles is to be secured thereto; and b. applying a row of tiles to said built-out wall face.

12. The method of claim 10 wherein said form board is of a cuttable material, includes an upper leveling surface meeting said side face, and has a slit extending lengthwise thereinto from said side face at a location spaced from said leveling surface; and said step of removing a section of said form board between said side face thereto and a surface thereof generally parallel to said side face thereof and a surface thereof generally parallel to said side face includes the steps of:

a. scribing a line on said leveling surface conforming to said contour defining a desired adjacent orientation of alignment for said tiles; and b. cutting said material along said scribed line generally parallel to said side face between said leveling surface and said slit to form said surface having said contour.

13. The method of claim 12 wherein the contour of said leveling surface of said form board is the same across the width of said board whereby the edge presented between said leveling surface and said surface formed within said board by cutting from said leveling surface to said slit retains the same elevation irrespective of the location along the width of said leveling surface at which said cut is made to remove said section.

14. A method of providing an alignment face along an irregular face of a concrete or the like wall comprising:

a. providing an elongated form board made of a cuttable material and having a side face meeting a leveling surface thereof;

b. positioning said form board with said side face thereof against said irregular face of said wall along the location at which said alignment surface is desired;

c. removing a section of said form board between said side face thereof against said irregular face and a surface of said form board inwardly thereof having a contour corresponding to the contour desired for said alignment face to define a cavity along the location at which said row of tiles is to be secured;

d. filling the cavity between said irregular wall face and said surface of said form board defining said desired alignment with a cement;

e. allowing said cement within said cavity to set to a self-supporting configuration at said surface of said form board to thereby form an alignment surface for said tiles conforming to said form board surface; and f. removing said form board from its position against said irregular face of said wall to expose said desired alignment surface.

15. The method of claim 14 wherein said form board further has a slit extending lengthwise thereinto from said side face at a location spaced from said leveling surface; and said step of removing a section of said form board between said side face thereof and a surface having a contour corresponding to said desired alignment surface includes the steps of:

a. scribing a line on said leveling surface conforming to the contour of said desired alignment surface; and b. cutting said material along said scribed line between said leveling surface and said slit to form said surface having said contour.

16. The method of claim 15 wherein the contour of said leveling surface of said form board is the same across the width of said board whereby the edge presented between said leveling surface and said surface formed within said board by cutting from said leveling surface to said slit retains the same elevation irrespective of the location along the width of said leveling surface at which said cut is made to remove said section.

17. The method of claim 14 wherein said alignment surface is provided as a reference face for securing a row of tile to said wall in a desired adjacent alignment, and said method further includes the steps after removing said form board from its position against said irregular face of:

a. applying a cement to said wall face to fill the same out to said alignment surface at the location at which the row of tiles is to be secured thereto; and b. applying a row of tiles to said built-out wall face.

* * * * *